US006303914B1

(12) United States Patent
Bono et al.

(10) Patent No.: US 6,303,914 B1
(45) **Date of Patent: *Oct. 16, 2001**

(54) MICROWAVE PACKAGING WITH IMPROVED DIVIDER

(75) Inventors: James Lee Bono, Cincinnati; Lewis Alexander Tucker, Fairfield, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/255,220

(22) Filed: Feb. 22, 1999

(51) Int. Cl.[7] ..... H05B 6/80; B65D 5/54

(52) U.S. Cl. ..... 219/730; 219/732; 219/762; 219/735; 426/234; 426/243; 99/DIG. 14

(58) Field of Search ..... 219/725, 727, 219/730, 732, 734, 735, 753, 762; 426/107, 234, 241, 243; 99/DIG. 14

(56) References Cited

U.S. PATENT DOCUMENTS

| | | | | |
|---|---|---|---|---|
| 4,286,136 | * | 8/1981 | Mason, Jr. | 219/732 |
| 4,571,474 | * | 2/1986 | Pomroy | 219/753 |
| 4,659,890 | * | 4/1987 | Viet | 219/753 |
| 4,678,882 | * | 7/1987 | Bohrer et al. | 219/730 |
| 4,785,160 | | 11/1988 | Hart | 219/730 |
| 4,935,592 | | 6/1990 | Oppenheimer | 219/10.55 E |
| 4,943,439 | | 7/1990 | Andreas et al. | 426/107 |
| 4,943,456 | * | 7/1990 | Pollart et al. | 219/730 |
| 5,034,234 | * | 7/1991 | Andreas et al. | 426/107 |
| 5,049,710 | | 9/1991 | Prosise et al. | 219/10.55 E |
| 5,084,601 | | 1/1992 | Andreas et al. | 219/10.55 E |
| 5,096,723 | * | 3/1992 | Turpin | 426/107 |
| 5,175,404 | | 12/1992 | Andreas et al. | 219/10.55 E |
| 5,200,590 | * | 4/1993 | Bowen et al. | 219/732 |
| 5,220,140 | | 6/1993 | Ball et al. | 219/10.55 |
| 5,244,682 | * | 9/1993 | Happ | 426/107 |
| 5,302,790 | * | 4/1994 | Turpin | 219/727 |
| 5,484,984 | | 1/1996 | Gics | 219/734 |
| 5,500,235 | | 3/1996 | Mendenhall et al. | 426/394 |
| 5,543,606 | | 8/1996 | Gics | 219/730 |
| 5,718,356 | * | 2/1998 | Nottingham et al. | 219/730 |
| 5,871,790 | | 2/1999 | Monier et al. | 426/107 |

FOREIGN PATENT DOCUMENTS

| | | | |
|---|---|---|---|
| 0 752 379 A1 | 1/1997 | (EP) | B65D/81/34 |
| 02-127240 | 5/1990 | (JP) . | |
| WO 9109791 | 7/1991 | (WO) . | |
| WO 93/17532 | 9/1993 | (WO) | B65D/81/34 |
| WO 9729966 | 8/1997 | (WO) . | |

* cited by examiner

*Primary Examiner*—Philip H. Leung
(74) *Attorney, Agent, or Firm*—Paul M. Ulrich

(57) ABSTRACT

The present invention is directed to a package for heating and/or cooking a food product in a microwave oven in which the package includes means for supporting the package at an angle between about 0 degrees to about 90 degrees relative to a horizontal surface. The present invention is also directed to a kit for heating and/or cooking a food product in a microwave oven. The kit comprises a first package containing the food products to be heated and/or cooked and a second microwaveable package. The microwave package of the present invention may also include a flexible, two-sided divider.

15 Claims, 6 Drawing Sheets

MICROWAVE PACKAGING WITH IMPROVED DIVIDER

FIELD OF THE INVENTION

The present invention relates to packaging useful for heating and/or cooking food products in a microwave oven which can be filled by a user at the time of use.

BACKGROUND OF THE INVENTION

Frozen food products, such as french fries, are commonly sold in bulk in large bags for heating in a conventional oven. Because of the extended time required for heating frozen food products in a conventional oven, these types of products are generally not practical for a single snack size serving. For this reason, frozen food products capable of being heated in a microwave oven are popular with consumers due to their ease of use, convenience and shorter cooking times as compared to products heated in a conventional oven. Presently available microwaveable products, such as frozen french fries, typically are packaged only in single serving, snack size containers, sold separately from bulk products, for use in conventional ovens. Thus, there remains a need in the art for a product that combines the large serving size of bulk frozen food products with the convenience of microwaveable single snack size products.

However, in order to attain consumer acceptance, microwave cooking must provide food products having sufficient exterior browning and crispness. Frozen food products such as french fried potatoes become soggy when cooked in a paper or cardboard package in a microwave oven due to the generation of steam during cooking. Typical microwave packaging includes a susceptor, a material that absorbs microwave energy and converts it into heat, to cook the food product. A conventional susceptor is usually made of a paper board material laminated or otherwise bonded to a polyester film coated with a metallic layer. The packaging can be made more flexible by laminating the metallized polyester film to paper. To combat the problem of soggy fries, prior art microwave packaging has included vent holes in an effort to allow the steam to escape during heating. Prior art microwave packaging is designed so that the package is laid horizontally on the floor of the microwave oven during cooking.

Attempts have been made to increase the contact between the susceptor and food product to increase browning and crispness by extruding stick shaped food products and surrounding each stick with susceptor material as shown in U.S. Pat. Nos. 4,943,439, 5,034,234, 5,096,723, 5,084,601, and 5,175,404. Although the arrangement shown in these patents improves exterior crispness, the design is expensive to produce and pack, does not allow steam to escape as easily as other prior art designs, and has proven difficult for consumers to remove the stick shaped food product after cooking. Moreover, this design does not allow the use of naturally shaped food products such as random cut french fries.

Despite the developments described above, food products cooked in current microwave packages often come out of the oven limp and soggy. This is due in part to the restrictive horizontal cooking orientation used in prior art packaging. The horizontal cooking orientation provides limp and soggy food products for several reasons. First, juices and oils generated during cooking are not allowed to drain from the product during cooking. Second, when the product is placed in a horizontal orientation, the product is in contact with the floor of the microwave oven which acts as a heat sink, preventing the product from reaching optimal cooking temperature. Third, conventional steam vent holes do not allow all of the steam to escape when the package is oriented horizontally. Finally, the prior art horizontal orientation does not allow for optimum utilization and absorption of the wave pattern of microwave energy during cooking.

Another example of prior art microwave packaging is found in U.S. Pat. Nos. 5,484,984 and 5,543,606. These patents disclose an ovenable food package for holding a food product. The package can be used in the microwave or conventional oven. The base of the package is constructed to include one interior gap between the food product and the base of the package to alleviate the effect of the floor of the microwave oven acting as a heat sink and withdrawing heat away from the food product during heating. Nowhere does the prior art disclose a non-horizontal, angled microwave heating package.

Therefore, it is an object of this invention to provide a microwave heating and/or cooking package that delivers hot, browned and crispy food products from the microwave oven while avoiding the drawbacks associated with the microwave packaging found in the prior art such as the formation of limp and soggy food products. It is another object of this invention to combine the large serving capability of a bulk package of frozen food products with the single serving convenience of a microwaveable package.

SUMMARY OF THE INVENTION

The present invention provides a package for heating food products in a microwave oven comprising an outer surface composed of a microwave transparent material and an inner surface composed of a microwave receptive material in which the outer and inner surfaces are laminated or bonded to each other. When assembled, the microwave package of the present invention forms a pocket for holding the food products to be heated. The package further includes means for supporting the package and the food products at an angle between about 0 degrees to about 90 degrees relative to the floor of the microwave oven. The microwave package of the present invention further includes vent holes formed through both the inner and outer surfaces to allow steam to escape from the package during heating. The microwave package of the present invention may be used to heat, reheat and/or cook almost any food product. Examples of food products that may be used with the present invention include frozen, refrigerated or room temperature french fries, onion rings, chicken nuggets, pizza, or fish sticks.

Another aspect of the present invention is a kit containing at least one bulk package of frozen food products and at least one microwave package of the type described above that is capable of being filled by a consumer at the time of use and that is suitable for heating and/or cooking the frozen food products. The kit of the present invention may contain almost any food product capable of being frozen and reheated. Examples of food products that may be used with the present invention include frozen french fries, onion rings, chicken nuggets, pizza, or fish sticks.

A third aspect of the present invention is a flexible, two-sided divider that can be inserted into the pocket of the microwave package of the present invention to divide the pocket into at least two smaller pockets thus increasing the amount of product/package contact.

The microwave package of the present invention provides microwave food products that are hot, crispy and brown on their exterior and that are appealing and appetizing to the consumer. The angled, non-horizontal orientation of the package of the present invention allows the juices and oils to drain from the product and allows more efficient release of the steam generated during cooking, avoiding the formation of soggy and limp food products. The present invention also avoids the formation of a heat sink in floor of the microwave thus allowing the product to reach optimal cooking temperature. The angled orientation of the present invention also allows for optimum utilization and absorption of the wave pattern of microwave energy during cooking thus achieving shorter cooking times compared to prior art microwave packaging. The flexible two-sided divider increases the product/susceptor contact area thus decreasing cooking time, and providing browner, crisper food products. The kit of the present invention gives the user flexibility and convenience by providing a single product that allows the user to choose whether to prepare a single, snack size serving or a larger, multiple serving. In addition, by allowing the product user to fill the microwave package at the time of use, the kit of the present invention avoids the complex french fry manufacturing and packing operations found in the prior art.

DETAILED DESCRIPTION

The microwave package of the present invention is formed from a laminate comprised of at least two layers of material with the first layer forming the outer surface of the package and the second layer forming the inner surface. The first layer is a paper board backing material such as solid bleached sulfate paper board. The paper board can be chosen to have some stiffness (12–16 point thickness) to provide support and stability to the package. The package can be made more flexible by using paper (5–10 point thickness) as the first layer. Each point represents one thousandth of an inch. The first layer must be transparent to microwave energy so that the microwave energy can reach the inner microwave receptive layer and food product.

The second layer in the laminate is a microwave receptive material, the susceptor. Any microwave receptive material may be used as the second layer. One example of a suitable microwave receptive material known in the art is metallized polyester film. Metallized polyester film is typically formed by applying a thin layer of a metal or metal-based material to a thin sheet of polyester. The first and second layers are bonded together using methods known in the art to form the laminate. A laminate suitable for use in the present invention is available from the Fort James Company, Milford, Ohio.

The microwave package of the present invention includes supporting means for supporting the package in a non-horizontal position during use. The package is oriented at an angle relative to the horizontal microwave oven floor. The support means can be of any form capable of supporting the package at the desired angle. Examples of suitable support means include one or more collapsible legs attached to the package and one or more collapsible legs integrally formed as a part of the package itself.

Figure 1:
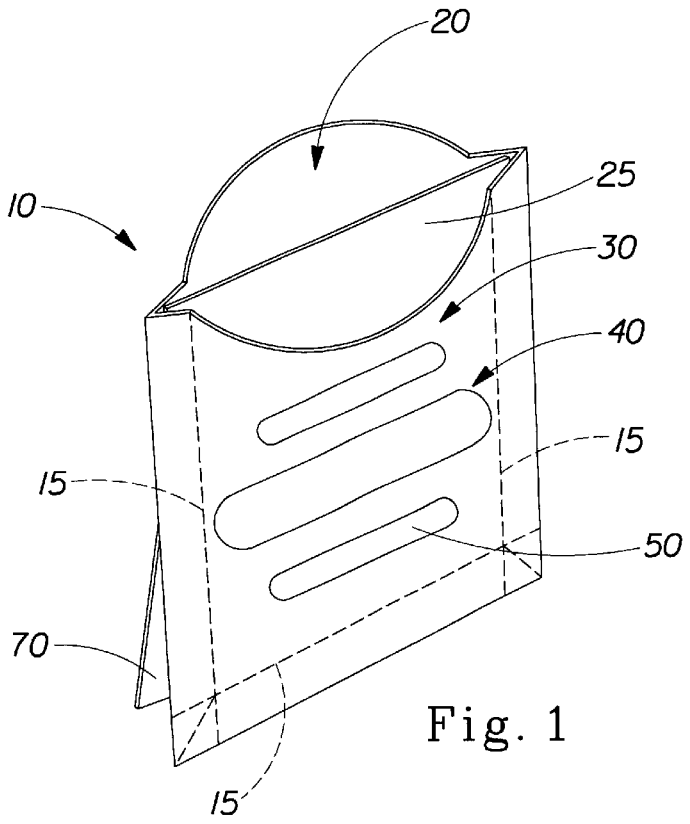
FIG. 1 is a schematic view of one embodiment of the present invention.

With reference to FIG. 1., one embodiment of the microwave package of the present invention is shown generally as reference numeral 10. The package includes inner susceptor layer 20, outer layer 30, vent holes 40, and score lines 15. The package is assembled to form pocket 50 which holds the food products to be heated. Score lines 15 allow the package to expand and contract to accommodate food products of various shapes and sizes. Vent holes 40 may be of any shape and size and the number and placement of the holes is not critical as long as steam is allowed to sufficiently escape during heating (may need to better quantify this). Suitable Do examples of vent hole shapes include circular and oval. The flexible, two-sided divider is depicted by reference numeral 25. Support means 70 supports the package at an angle relative to the microwave oven floor. Support means 70 is optional but presently preferred.

Figure 2:
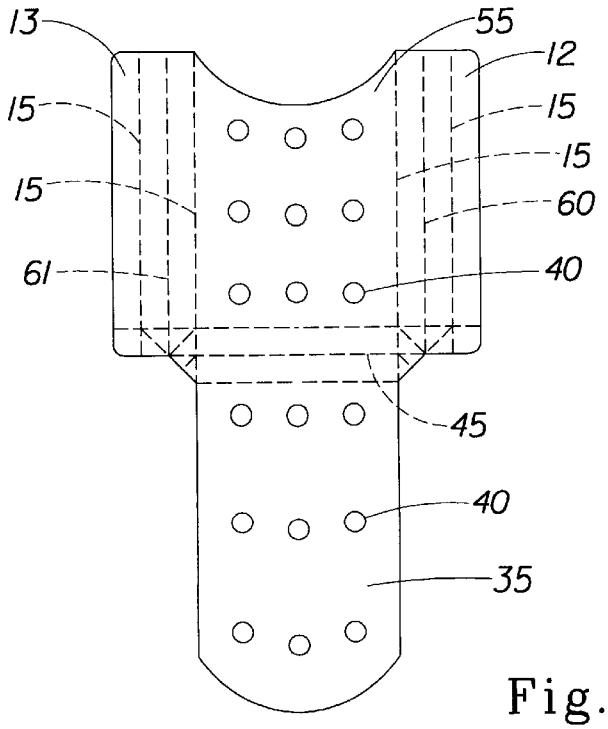
FIG. 2 is a top plan view of a blank suitable for forming a package according to one embodiment of the present invention.
Figure 3:
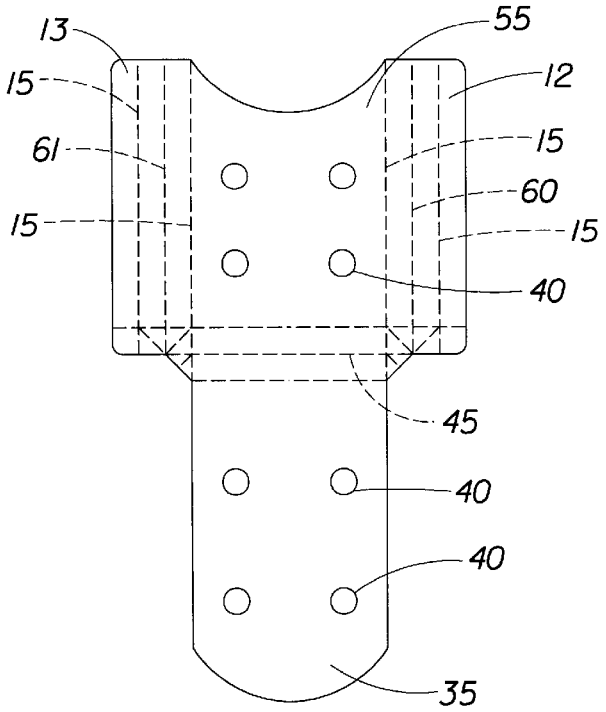
FIG. 3 is a top plan view of a blank suitable for forming a package according to one embodiment of the present invention.
Figure 4:
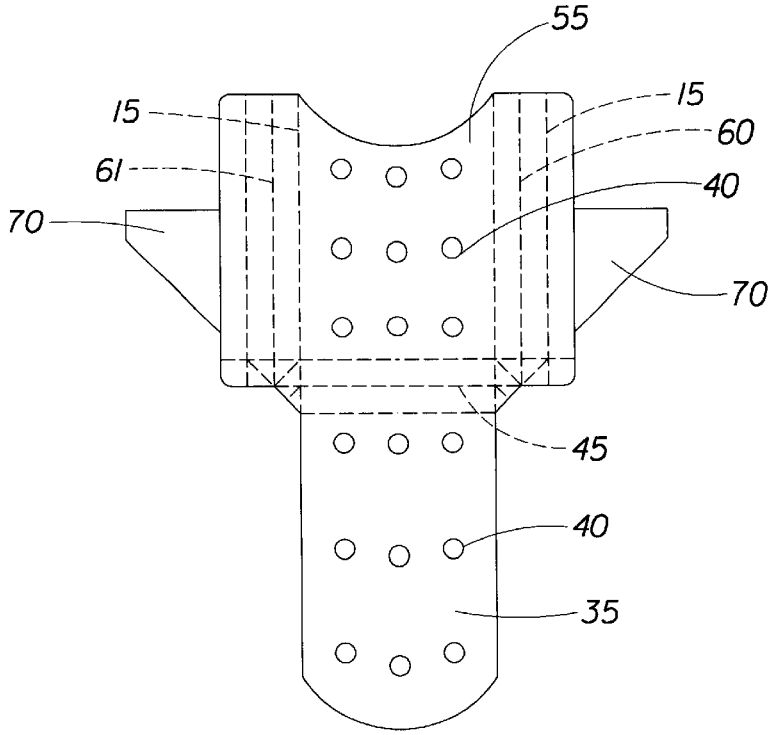
FIG. 4 is a top plan view of a blank suitable for forming a package according to one embodiment of the present invention.

As shown in FIGS. 2–4, the microwave package portion of the present invention may be initially formed as a flat blank comprising the first and second layers laminated together. The blank is assembled quite easily to form the microwave package of the present invention. Flap 35 is folded upward along fold line 45 until it is flush with body 55. Fold line 45 becomes the bottom of the assembled package. Flaps 12 and 13 are then folded inward along fold lines 60 and 61, respectively, until they make contact with flap 35. Flaps 12 and 13 are bonded to flap 35 using any conventional adhesive, capable of withstanding a microwave environment, to form the package shown in FIG. 1. Although support means 70 is not shown in FIGS. 2 and 3, support means 70 can be used with the designs depicted in FIGS. 2 and 3, similar to FIG. 4.

Figure 5:
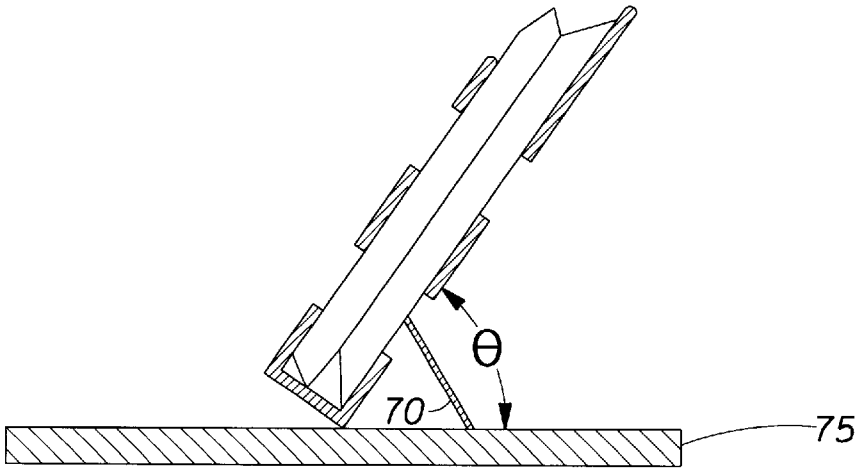
FIG. 5 is a side view of one embodiment of the present invention.

FIG. 5 shows a side view of the microwave package of the present invention. Supporting means 70 acts to orient the package at an angle Θ relative to the horizontal floor of the microwave oven 75. The angle Θ is preferably between about zero degrees and about 90 degrees. More preferably, the angle Θ is between about 30 and about 60 degrees. Most preferably, the angle Θ is about 45 degrees. Although support means 70 is shown in FIG. 5 as a single leg, the support means 70 may be in any form capable of supporting the weight of the package and the food products contained therein. Support means 70 may be attached to the package using any conventional adhesive which is capable of withstanding a microwave environment. Alternatively, support means 70 may be formed as an integral part of the package. Whatever the form of support means 70, it preferably contains one or more fold lines so that it can be folded flat during shipping and/or storage. Although the angle Θ is shown in FIG. 5 as being measured in a counterclockwise direction, the angle Θ can also be measured in a clockwise direction from the floor of the microwave oven. Thus, the microwave package portion of the present invention is preferably oriented at any angle other than horizontally on the microwave floor 75.

Figure 6A:
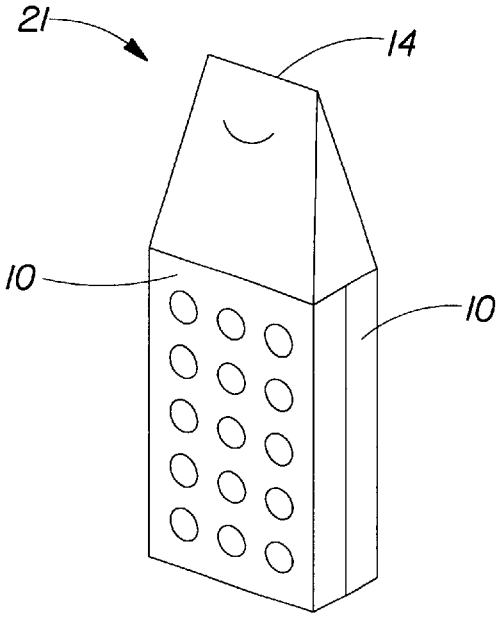
FIG. 6A is a perspective view of one embodiment of the present invention.
Figure 6B:
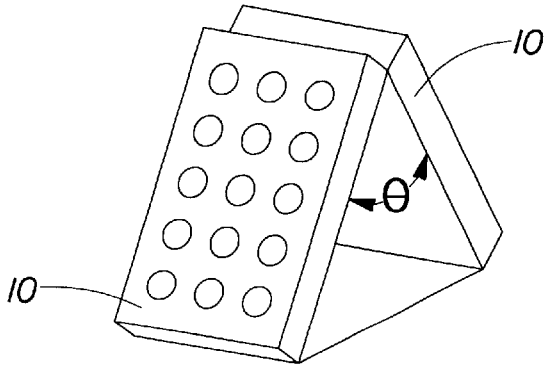
FIG. 6B is a perspective view of the embodiment of FIG. 6A shown in the open position.

FIGS. 6A and 6B show a further embodiment of the invention, FIG. 6A shows the closed position and FIG. 6B shows the open position. In this embodiment, two packages 10 of the present invention are joined together at one end to form a "teepee" design 21 in which the two packages 10 are joined by fold line 14. Each package pivots about fold line 14 so that the teepee unit can be arranged at various angles Θ ranging from zero degrees (vertical) to 180 degrees (horizontal). The teepee unit 21 provides all the advantages of the single package design plus the added advantage of increased serving size.

Figure 7A:
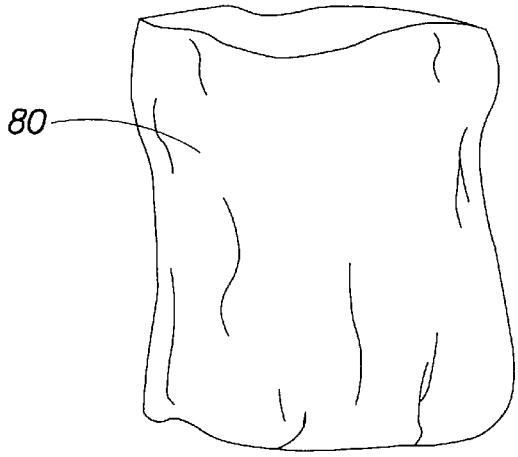
FIGS. 7A and 7B are schematics showing an embodiment of the kit of the present invention.
Figure 7B:
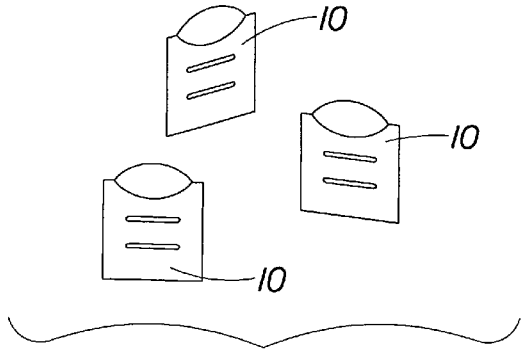

As shown in FIG. 7A, the bulk package 80 which forms a part of the kit of the present invention may be of any form suitable for holding frozen food products. The package may be a box, a bag or other similar form. Examples of materials suitable for use in the present invention include paper board similar to that used as the first layer of the microwave package and plastics such as polyester and polyethylene. Preferably, the bulk package is made reclosable using means conventional and well known in the prior art such as zip locking, zipping mechanisms or reclosable adhesives. The kit may contain one large bulk package 80 containing several servings or several smaller bulk packages 80 containing individual servings or a combination of both. The kit of the present invention is preferably formed by combining at least one bulk package 80 containing food products and at least one microwave package 10 shown in FIG. 7B.

Figure 8:
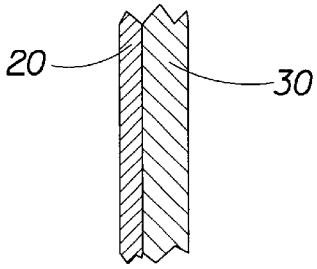
FIG. 8 is a cross-sectional view of one embodiment of the laminate used to form the package of the present invention.
Figure 9:
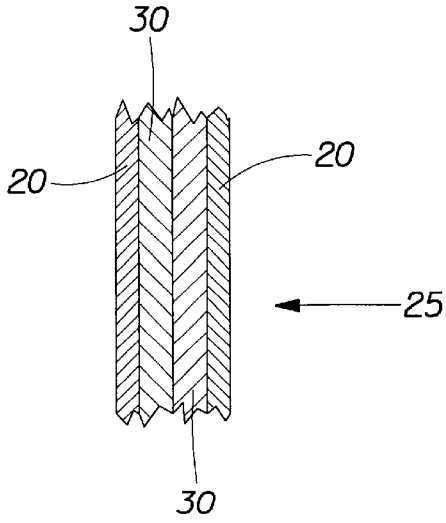
FIG. 9 is a cross-sectional view of one embodiment of the flexible, two-sided divider of the present invention.

Referring to FIGS. 8 and 9, the flexible two-sided expandable divider 25 of the present invention is preferably formed of the same laminate used to make the microwave package. The divider 25, shown in FIG. 8, preferably comprises a conventional piece of laminated paper/susceptor material, described above, which is folded over with the paper side 30 facing in and bonded to itself to obtain a single piece 25 having susceptor material 20 on both sides as shown in FIG. 9. However, the divider 25 may also be formed of a single piece of paper board coated on both sides with metallized polyester film. As shown in FIG. 1, the divider 25 is inserted into the pocket 50 of the microwave package to divide the pocket 50 into at least two smaller pockets for holding food products to be heated and/or cooked.

Figure 10A:
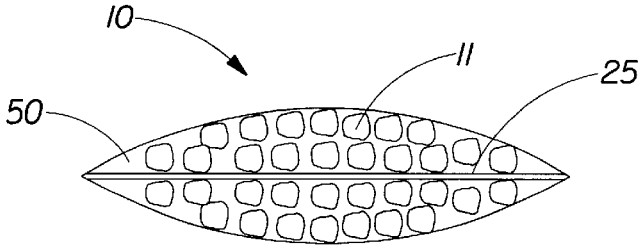
FIG. 10A is a top view showing one embodiment of the present invention prior to heating.
Figure 10B:
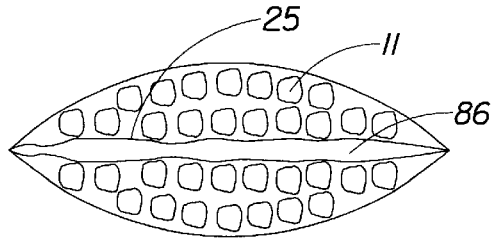
FIG. 10B is a top view showing one embodiment of the present invention after heating.

In reference to FIGS 10A and 10B, in a preferred embodiment, the flexible two-sided divider 25 is designed to delaminate and expand during heating. FIG 10A shows a top view of a microwave package of the present invention, prior to heating, with a divider 25 inserted in the pocket 50. FIG. 10B is a top view of a microwave package of the present invention, after heating, in which the divider 25 has delaminated and expanded during the heating process. This delamination may be obtained in one of several ways. Using the fold-over design described above, the divider may be bonded using a microwaveable adhesive having a specified bond strength that will allow the bonded sections to separate during the heating process. Alternatively, the adhesive may be applied to the inner paper board surface in a desired pattern so that the divider 25 will delaminate at the portions where no adhesive has been applied. A third possibility includes decreasing the amount of adhesive used for portions where delamination is desired. The pattern of delamination can be determined by controlling the amount, placement and/or type of adhesive applied to the divider 25.

Whatever the method used to achieve delamination of the flexible two-sided divider 25, delamination provides superior microwaving results as compared to prior art microwave packaging. As shown in FIG. 10B, during delamination, the delaminated portions of the divider 25 expand outwardly away from the divider 25. Due to its flexible nature, as delaminated divider 25 expands, it conforms to the surface of the food product 11 nearest the divider thus causing more intimate contact between the food product and the susceptor material on the divider 25. This increased product/susceptor contact improves overall product taste by increasing product crispness and reducing product toughness. In addition, the expanded divider provides an insulating effect that keeps the food product hotter for longer periods after heating. As shown in FIG. 10B, the expanded divider creates a air pocket 86. The air in the air pocket 86 is heated during microwave heating and this heated air is what provides the insulating effect.

Figure 11A:
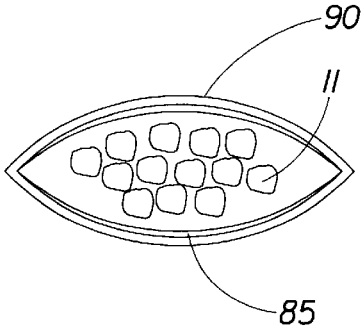
FIG. 11A is a top view showing one embodiment of the present invention prior to heating.
Figure 11B:
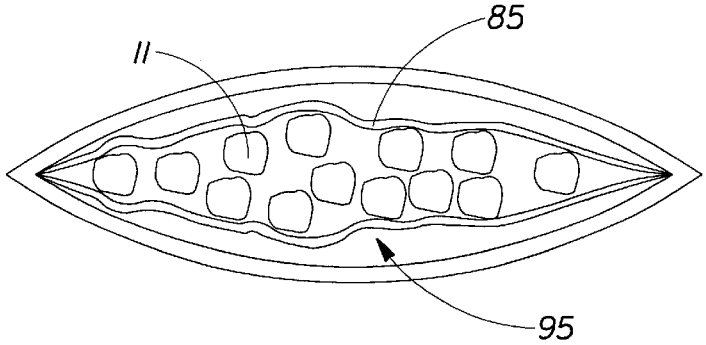
FIG. 11B is a top view showing one embodiment of the present invention after heating.

As shown in FIGS. 11A and 11B, the outer walls 90 of the microwave package itself may also be designed to delaminate during heating. Delamination and expansion of the package can be achieved in the same manner as described above for the divider 25. As with the divider, when designed to delaminate, the inner walls of the package 85 expand and conform to the shape of the food product 11 increasing product/susceptor contact and providing the benefits described above for the divider. The delamination also creates air pocket 95 which acts to insulate the food product 11, keeping it warm after the package is removed from the microwave.

Placing the microwave package at an angle in accordance with the present invention still allows contact with the susceptor material which increases the temperature at the product/package interface and improves surface browning and exterior crispness. In addition, the angled orientation of the present invention has shown to shorten the amount of time necessary for complete heating as well as providing crisper, browner fries as compared to the prior art as shown in the following examples.

EXAMPLES

In Examples 1–3, three different tests were run to determine the optimum microwaving time for cooking frozen french fries in the microwave package portion of the present invention. In each test, the package was filled with 25–30 randomly sized and shaped frozen french fries arranged parallel to each other. FIG. 1 shows the type of package used in the Examples. In Examples 1–7, the two-sided divider was not used. Each package, filled with frozen fries, was placed one at a time in a 650 W microwave oven. Each package was placed in the same position within the oven. Four thermocouple probes were inserted in various positions within the french fries to measure the temperature of the fries during the cooking process. The thermocouple probes were inserted in the same places for each package tested. In Examples 1–3 the packages were each oriented at a 45 degree angle with respect to the floor of the microwave oven. The temperatures recorded by each thermocouple probe were recorded at 30 second intervals and all temperatures were measured in degrees Fahrenheit. After the cooking process was completed, the physical characteristics of the french fries and the package were observed and recorded.

Example 1

In this test, the package was heated for 3 minutes. The results were as follows.

| Probe # | 30 secs | 60 secs | 90 secs | 120 secs | 150 secs | 180 secs |
|---|---|---|---|---|---|---|
| 1 | 39 | 106 | 209 | 210 | 210 | 210 |
| 2 | 58 | 132 | 211 | 212 | 213 | 213 |
| 3 | 49 | 115 | 202 | 214 | 218 | 227 |
| 4 | 58 | 210 | 211 | 213 | 211 | 222 |

The french fries were golden brown in appearance. The package was hot to the touch and soaked with oil.

Example 2

In this test, the package was heated for 2.5 minutes. The results were as follows.

| Probe # | 30 seconds | 60 seconds | 90 seconds | 120 seconds | 150 seconds |
|---|---|---|---|---|---|
| 1 | 72 | 167 | 213 | 213 | 216 |
| 2 | 76 | 211 | 211 | 211 | 212 |
| 3 | 59 | 210 | 211 | 211 | 212 |
| 4 | 117 | 212 | 217 | 229 | 251 |

The french fries were not as brown as and were more soggy than the fries in Example 1. The fries did become somewhat crispier after sitting for 30 seconds. The package was hot to the touch.

Example 3

In this test the fries were heated for 3.5 minutes. The results were as follows.

| Probe # | 30 secs | 60 secs | 90 secs | 120 secs | 150 secs | 180 secs | 210 secs |
|---|---|---|---|---|---|---|---|
| 1 | 55 | 132 | 210 | 210 | 211 | 211 | 211 |
| 2 | 60 | 209 | 214 | 228 | 232 | 242 | 256 |
| 3 | 46 | 99 | 211 | 213 | 213 | 216 | 221 |
| 4 | 109 | 215 | 223 | 229 | 238 | 251 | 262 |

The french fries were burned on one surface, dried out, very crisp and overcooked. The package was hot to the touch. The conclusion reached from Examples 1–3 was that 3 minutes was the optimum cooking time for the microwave package of the present invention.

The object of Examples 4–7 was to determine the optimum angle of orientation for the microwave package of the present invention. The packages, thermocouple probes, french fries, and microwave were identical to those used in Examples 1–3.

Example 4

In this test the package was oriented at a 30 degree angle relative to the floor of the microwave oven. The results were as follows.

| Probe # | 30 secs | 60 secs | 90 secs | 120 secs | 150 secs | 180 secs |
|---|---|---|---|---|---|---|
| 1 | 99 | 188 | 212 | 214 | 216 | 218 |
| 2 | 52 | 140 | 221 | 235 | 239 | 243 |
| 3 | 42 | 130 | 210 | 212 | 215 | 219 |
| 4 | 44 | 178 | 211 | 225 | 233 | 237 |

The french fries were golden brown and crispy and the ends of the fries were slightly burnt. The package was hot to the touch and soaked with oil.

Example 5

In this test the package was oriented at a 60 degree angle relative to the microwave oven floor. The results were as follows.

| Probe # | 30 secs | 60 secs | 90 secs | 120 secs | 150 secs | 180 secs |
|---|---|---|---|---|---|---|
| 1 | 33 | 112 | 211 | 212 | 213 | 219 |
| 2 | 45 | 167 | 212 | 215 | 217 | 221 |
| 3 | 46 | 117 | 206 | 210 | 211 | 211 |
| 4 | 30 | 131 | 210 | 212 | 215 | 224 |

The french fries were golden brown and crispy. Package was hot to the touch and less oil soaked than the package oriented at a 45 degree angle (Example 1).

Example 6

In this test the package was oriented vertically at a 90 degree angle relative to the microwave oven floor. The results were as follows.

| Probe # | 30 secs | 60 secs | 90 secs | 120 secs | 150 secs | 180 secs |
|---|---|---|---|---|---|---|
| 1 | 79 | 146 | 206 | 211 | 212 | 212 |
| 2 | 53 | 104 | 205 | 226 | 231 | 235 |
| 3 | 68 | 152 | 206 | 213 | 216 | 220 |
| 4 | 29 | 132 | 202 | 210 | 210 | 211 |

The french fries were golden brown with the ends of the fries being somewhat brown. The package was hot to the touch and was less oil soaked than other orientations.

Example 7

In this test the package was oriented horizontally on the microwave floor at a 0 degree angle. The results were as follows.

| Probe # | 30 secs | 60 secs | 90 secs | 120 secs | 150 secs | 180 secs |
|---|---|---|---|---|---|---|
| 1 | 31 | 59 | 195 | 215 | 217 | 219 |
| 2 | 42 | 77 | 149 | 214 | 216 | 218 |
| 3 | 39 | 68 | 150 | 210 | 210 | 211 |
| 4 | 66 | 140 | 211 | 212 | 218 | 234 |

The french fries were golden brown but soggy. Fries on the bottom of the package was more soggy than the fries on the top. The fries were undercooked as compared to Examples 1 (45 degrees, cooked for 3 minutes) and 4–6 (30, 60, and 90 degrees, respectively) which were at an angled orientation. The package was hot to the touch and the bottom/back of the package was soaked with oil.

Figure 12:
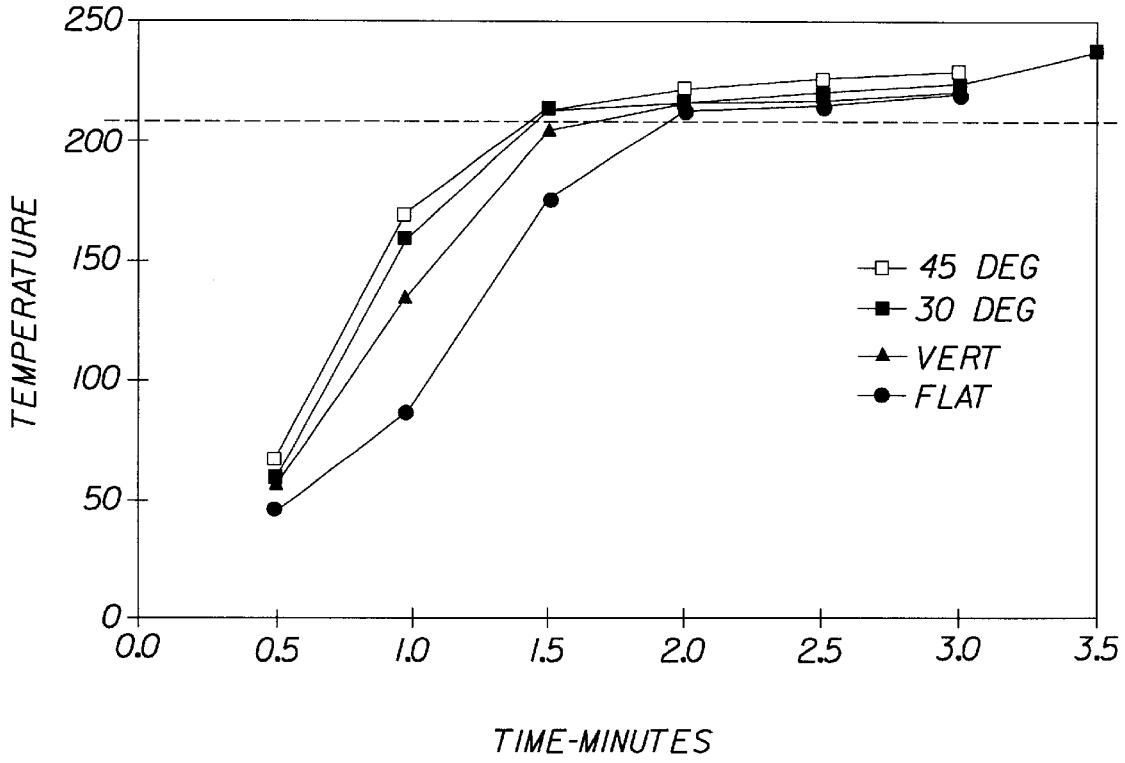
FIG. 12 is a graph showing temperature versus time during microwave heating.

The conclusions reached from the preceding examples were that 45 degrees was the optimum orientation and that all of the angled orientations were superior to the horizontal, 0 degree orientation. A line graph summarizing the results of the foregoing examples is shown in FIG. 12.

Examples 8 and 9 were conducted to determine the effect of adding the flexible two-sided divider of the present invention and the effect of changing the number of vent holes. Examples 8 and 9 differed in the number of vent holes provided in the package.

Example 8

In this test two packages were compared. Package #1 had two vent holes on each side of the package and no divider. Package #2 had the same vent holes as the package #1 but did have a divider according to the present invention. The packages were filled with frozen french fries in a manner similar to Examples 1–7. Each package was separately heated for two minutes in a 650 W microwave oven. Each package was placed in the same position in the microwave and each package was oriented at a 45 degree angle relative to the floor of the microwave. After heating, the physical characteristics of the french fries were observed and recorded.

The fries from package #1 were clumped together, lightly browned and had a tough outer crust. The fries from package #2 were less clumped, crispier, and had less oil runoff than those from package #1. The fries from package #2 were superior to those from package #1 with respect to browning and the tough outer crust.

Example 9

Two packages were compared in this test as well, packages 3 and 4. The test parameters were identical to Example 8 except that the packages had three vent holes on the front of the package and four vent holes on the back. Package #3 did not have a divider while package #4 did.

The fries from package #3 were browner and crispier than packages #1 and #2 and had less clumping and toughness than packages 1 and 2. The fries from package #4 were browner than packages 1–3 but were slightly overcooked and dry. The toughness was equal to #3 and less than packages 1 and 2. Another result of this Example was that better venting of the package equated to shorter cooking time in the microwave.

Although the foregoing examples were completed using frozen french fries, any other frozen or unfrozen food could have been substituted for the frozen french fries.

Many variations of the present invention within the scope of the following claims will be apparent to those skilled in the art once the principles described above are understood.

What we claim is:

1. A package for heating and/or cooking a food product in a microwave oven comprising, an outer surface composed of a microwave transparent material;

an inner surface composed of a microwave receptive material;

wherein said inner and outer surfaces are laminated together;

wherein said package forms a pocket for holding said food product to be heated and/or cooked;

wherein said package includes a flexible two-sided delaminating divider inserted in said pocket, said divider partially delaminates during heating causing a surface of said divider to conform to a surface of said food product;

wherein said package includes one or more vent holes; and wherein said package includes means for supporting said package and said food products at an angle between 0 degrees and 90 degrees relative to a horizontal surface.

2. The package according to claim 1, wherein said angle is between about 30 degrees and about 60 degrees.

3. The package according to claim 1, wherein said angle is about 45 degrees.

4. The package according to claim 1, wherein said vent holes are circular shaped.

5. The package according to claim 1, wherein said vent holes are oval shaped.

6. The package according claim 1, wherein said supporting means comprises one or more legs pivotably attached to said outer surface.

7. The package according to claim 1, wherein said supporting means comprises one or more legs integrally formed with said package.

8. The package according to claim 1, wherein said food product is selected from the group consisting of frozen french fried potatoes, frozen onion rings, frozen chicken nuggets, frozen fish sticks, and frozen pizza.

9. The package according to claim 1, wherein said food product is selected from the group consisting of refrigerated french fried potatoes, refrigerated onion rings, refrigerated chicken nuggets, refrigerated fish sticks, and refrigerated pizza.

10. The package according to claim 1, wherein said food product is selected from the group consisting of room temperature french fried potatoes, room temperature onion rings, room temperature chicken nuggets, room temperature fish sticks, and room temperature pizza.

11. The package according to claim 1, wherein said microwave receptive material is a metallized polyester film.

12. The package according to claim 1, wherein said microwave transparent material is paper board.

13. A package for heating and/or cooking frozen french fried potatoes in a microwave oven comprising:

an outer surface composed of a microwave transparent material;

an inner surface composed of a microwave receptive material;

wherein said inner and outer surfaces are laminated together:

wherein said package forms a pocket for holding said french fried potatoes to be heated and/or cooked;

wherein said package includes a flexible two-sided delaminating divider inserted in said pocket, said divider partially delaminates during heating causing a surface of said divider to conform to a surface of said food product;

wherein said package includes one or more vent holes; and wherein said package includes means for supporting said package and said french fried potatoes at about a 45 degree angle relative to a horizontal surface.

14. A package for heating and/or cooking a food product in a microwave oven comprising:

an outer surface composed of a microwave transparent material;

an inner surface composed of a microwave receptive material;

wherein said inner and outer surfaces are laminated together and said package forms a pocket for holding said food product to be heated and/or cooked;

a leg pivotally attached to said outer surface, said leg supports said package and said food products at an angle between 0 degrees and 90 degrees relative to a horizontal surface;

at least one or more vent holes disposed within said package; and a flexible two-sided delaminating divider inserted in said pocket, said divider partially delaminates during heating causing a surface of said divider to conform to a surface of said food product.

15. A package for heating and or cooking a food product in a microwave oven comprising:

an outer surface composed of a microwave transparent material;

an inner surface composed of a microwave receptive material;

a leg integrally formed with said package, said leg supports said package and said food products at an angle between 0 degrees and 90 degrees relative to a horizontal surface, said leg having a fold line whereby said fold line allowing said leg to fold flat during shipping and storage; and at least one or more vent holes disposed within said package; and flexible two-sided delaminating divider inserted in said pocket, said divider partially delaminates during heating causing a surface of said divider to conform to a surface of said food product.

* * * * *